US006116690A

United States Patent [19]

Larson

[11] Patent Number: 6,116,690

[45] Date of Patent: Sep. 12, 2000

[54] HEIGHT ADJUSTABLE WORK CHAIR HAVING A NON-SWIVEL SEAT

[76] Inventor: John E. Larson, P.O. Box 1197, Hamilton, Mont. 59840

[21] Appl. No.: 08/925,088

[22] Filed: Sep. 8, 1997

[51] Int. Cl.[7] ..... A47C 3/30; A47C 3/40

[52] U.S. Cl. ..... 297/344.19; 248/404

[58] Field of Search ..... 247/344.19; 248/404, 248/422; 297/344.18

[56] References Cited

U.S. PATENT DOCUMENTS

| | | | |
|---|---|---|---|
| 1,999,848 | 4/1935 | Ries | 297/344.19 |
| 2,216,348 | 10/1940 | Hunsicker | 248/404 |
| 2,923,344 | 2/1960 | La Voie et al. | 248/404 |
| 4,408,801 | 10/1983 | Edel et al. . | |
| 4,934,723 | 6/1990 | Dysarz | 297/344.19 |
| 5,078,351 | 1/1992 | Gualtieri | 248/404 |
| 5,437,236 | 8/1995 | Zeiner | 248/404 |

*Primary Examiner*—Anthony D. Barfield
*Attorney, Agent, or Firm*—Jerry Johnson

[57] ABSTRACT

A non-swiveling height adjustable work chair comprises a seat, a base, and a non-swiveling height adjustment column disposed intermediate the base and the seat. The height adjustment column comprises at least two telescoping height adjustment mechanisms, wherein the telescoping height adjustment mechanisms secure the seat against rotation in relation to the chair base. The chair additionally comprises a lever to actuate the height adjustment mechanisms. The height adjustment column may typically comprise a single stand tube having a first and a second end, wherein the first end is attached to the chair base and extends vertically therefrom, and the second end includes at least two holes through which the telescoping height adjustment mechanisms pass. Or, the height adjustment column may comprise at least two stand tubes each having a first and a second end, wherein the first end is attached to the chair base and extends vertically therefrom, and wherein the second end includes a hole through which the telescoping height adjustment mechanism passes. Each telescoping height adjustment mechanism utilized in the work chair typically comprises a gas spring. The gas springs comprise a cylinder; a piston disposed within the cylinder and extending downwardly therefrom to a secured position on the chair base from where it supports the gas spring; a gas flow control valve disposed within the cylinder; and a pressurized gas disposed within the cylinder.

6 Claims, 3 Drawing Sheets

HEIGHT ADJUSTABLE WORK CHAIR HAVING A NON-SWIVEL SEAT

BACKGROUND

Height adjustable work chairs are used in office environments as well as in industry. These chairs typically include a seat that swivels in relation to the base of the chair. The height adjustment is typically obtained from the construction of the height adjustment mechanism which is usually a gas spring. This gas spring is a telescoping column that includes a gas cylinder that includes a pressurized gas such as nitrogen; a piston extending downwardly from the cylinder which supports the cylinder in an elevated position and includes an end which secures the gas spring to the chair base; and a valve located within the cylinder which allows the movement of gas within the cylinder.

The top of the cylinder is secured within the chair tilt mechanism which is also the mechanism that supports the chair seat and chair back. The chair tilt mechanism is also known as the seat support mechanism. Also included in the tilt mechanism is a lever that actuates the valve located in the gas spring. The valve typically includes a pin extending from the top of the cylinder which when depressed by the lever allows gas to move through the valve and lower the cylinder if a force exceeding gas pressure is applied on the spring or raise the cylinder if no force is applied on the spring.

The gas spring is supported in a vertical position between the chair base and the chair tilt mechanism by a vertical stand tube. The stand tube includes an opening sized so that the cylinder of the gas spring can move vertically yet remain supported by the stand tube regardless of the vertical position of the cylinder.

The gas spring which is responsible for height adjustment in work chairs also allows the seat to swivel in relation to the base. The gas spring cylinder which is secured to the chair seat through the chair tilt mechanism rotates freely in relation to the piston which supports it. It is this rotation which provides the swivel in most work chairs. Additionally the end of the piston which is attached to the chair base may also include ball bearings or other means to allow the piston to rotate in relation to the base while remaining secured to the base. In this way, the gas spring which is a very inexpensive mechanism to manufacture provides both height adjustment and swivel movement of the chair seat in relation to the base.

The swivel movement provided by the gas spring is often in addition to the mobility provided to a work chair through the use of casters. Accordingly, a chair seat may actually be able to rotate or swivel in relation to the floor by the rotation of the gas spring cylinder in relation to the gas spring piston; the rotation of the piston in relation to the chair base; and the rotation of the chair base in relation to the floor through the use of swiveling wheeled casters. The cumulative effect of numerous swivel points tends toward instability of the chair and a lessening of chair control by the user.

Although the swivel movement of the chair seat is generally considered to be desirable for work chairs there are problems associated with this feature. Those who possess a physical or psychological disability and many agile people, as well often experience difficulties in using the chair to stabilize themselves while sitting because of the excessive movement caused by the swiveling seat. This problem is compounded by the inclusion of casters which make the chair even less stable. These same difficulties are also experienced when the chair user attempts to maneuver the chair to different locations.

Should the user of the chair desire to minimize this movement the chair user could replace the chair casters with ones that are pressure braked or lockable. There is, however, no current economical means available to lock a gas spring height adjustable work chair seat against swivel movement. Because of the widespread use of chairs incorporating seat swivel movement, the simple of sitting has become dangerous for many chair users.

Elevated work chairs also benefit from height adjustment but are rendered unstable by seat swivel movement. These work chairs may or may not include swiveling wheel casters. The chairs are elevated for such purposes as to allow a user to be at a proper height to operate machinery controls in an industrial setting or to sit in an elevated position at a drafting table. Mounting or dismounting an elevated swiveling chair has caused numerous injuries in the work place. These injuries are typically caused by the user under correcting, over correcting, or not correcting for the radical swiveling action of the seat. The swiveling action of the seat is a response to the forces inherent with the user's attempted placement of their body onto or off the chair. Climbing onto or off of an elevated swiveling chair has caused numerous injuries in the work environment. These injuries are typically caused by the user missing his or her body placement on the chair due to the radical seat movement associated with excessive swiveling or the chair seat. This causes the user to lose his balance when the chair seat swivels unexpectedly.

An additional problem with excessive chair seat swivel is the inability of the chair user to position the individual spokes of a castered chair base properly under the seat so that the base is able to function as a foot rest. When the user attempts to rotate the chair base through body movement the chair seat swivels which prevents the user from repositioning the chair base as desired.

For the above mentioned reasons there is needed a work chair that inexpensively provides height adjustment through the use of gas springs but also provides a high level of stability by preventing the chair seat from swiveling in relation to the chair base.

SUMMARY

The work chair of the present invention satisfies the previous mentioned need for a stable work chair that utilizes inexpensive gas springs for height adjustment but prevents seat swivel.

The height adjustable work chair of the present invention comprises a seat, a base, and a non-swiveling height adjustment column disposed intermediate the base and the seat. The height adjustment column comprises at least two telescoping height adjustment mechanisms, wherein the telescoping height adjustment mechanisms secure the seat against rotation in relation to the chair base. The work chair of the present invention additionally comprises means to actuate the height adjustment mechanisms.

The height adjustment column may typically comprise a single stand tube having a first and a second end, wherein the first end is attached to the chair base and extends vertically therefrom, and the second end includes at least two holes through which the telescoping height adjustment mechanisms pass. Or, the height adjustment column may comprise at least two stand tubes each having a first and a second end, wherein the first end is attached to the chair base and extends vertically therefrom, and wherein the second end includes a hole through which the telescoping height adjustment mechanisms passes.

Each telescoping height adjustment mechanism utilized in the work chair typically comprises a gas spring. The gas springs comprise a cylinder; a piston disposed within the cylinder and extending downwardly therefrom to a secured position on the chair base from where it supports the gas spring, and wherein the cylinder rotates freely about the piston; a gas flow control valve disposed within the cylinder; and a pressurized gas disposed within the cylinder.

The work chair of the present invention also includes a means to actuate the height adjustment mechanisms which actuates the valve of each lockable gas spring telescoping height adjustment mechanism. The means to actuate the height adjustment mechanism comprises a lever that toggles between a first position wherein the valve of each telescoping height adjustment mechanism is not actuated and a second position wherein the valve of each telescoping height adjustment mechanism is actuated. The lever in the second position actuates the valve to allow gas to move through the valve which lowers the cylinder if a force exceeding the gas pressure is applied on the gas spring or raises the cylinder if a force less than the gas pressure is applied on the gas spring.

Additionally, the chair seat additionally typically includes a seat support mechanism which includes receiving means for receiving each telescoping height adjustment mechanism. The seat support mechanism additionally supports the lever for actuating the height adjustment mechanism.

The work chair of the present invention provides benefits that have previously been unavailable to users of work chairs who desire a vertically adjustable work chair that includes a seat that does not swivel.

A first benefit offered by the work chair of the present invention is increased stability that makes getting into and out of the chair much safer. This feature is of particular benefit to users who have a physical disability or to users of elevated work chairs. In either case there are difficulties in getting into or out of the chair and a corresponding need for chair stability. Should the chair seat move suddenly the user may fall.

The benefit derived from removing chair seat swivel may be realized in work chairs that have casters as well as those that do not. Casters that include pressure braking or locking features are readily available and are inexpensive. Because of this, a user of a work chair that desires chair mobility but also desires maximum chair stability could easily lock a caster rendering the chair immoveable. Once the user is safely seated, the user could easily unlock the caster. This feature would be beneficial to anyone with a physical disability such as someone accessing a work chair from a wheel chair, someone on crutches, someone with common back pain, or someone with other physiological or psychological problems.

Even if regular non-locking casters are used on the work chair of the present invention, the chair remains much more stable than a similar chair that includes a seat that swivels freely.

Users getting onto or off of an elevated work chair would also be much less likely to have the chair move suddenly while ascending or descending the chair which could cause the user to fall. Once again, the feature on a non-swiveling seat in a height adjustable work chair according to the present invention would apply both to work chairs that include casters and those that do not.

Another advantage of the work chair of the present invention is that it secures a height adjustable seat in a fixed position in relation to the chair base. This allows the chair user to use the spokes of the chair base as foot rests and ensures that the foot rests are always at the desired location. The use of the chair base as a foot rest is very common and a chair utilizing the benefits of the present invention make the chair base more easily used in this function. The work chair provides this benefit while still allowing the chair to be fully moveable if the chair includes casters.

Many users may find the work chair of the present invention to actually be much more maneuverable than existing work chairs that include swivel seats. The added maneuverability is due to the fact that the entire chair will move as a complete unit with the body. Chairs that allow the seat to swivel in relation to the chair base are not able to respond to a users body movements as efficiently as the non-swivel work chair of the present invention.

The work chair of the present invention offers greater durability than that of typical gas spring height adjustable work chairs. The work chair uses two points to support the chair seat which distributes the stresses associated with sitting on the seat. This feature greatly extends the life of the gas springs used in the chair.

The work chair of the present invention uses inexpensive gas springs that are readily available to chair manufacturers. A work chair in accordance with the present invention could also be manufactured using low cost manufacturing techniques desired by chair manufacturers. These and other advantages of the present invention will become apparent upon inspection of the accompanying specification, claims, and drawings.

DRAWINGS

DESCRIPTION

Figure 1:
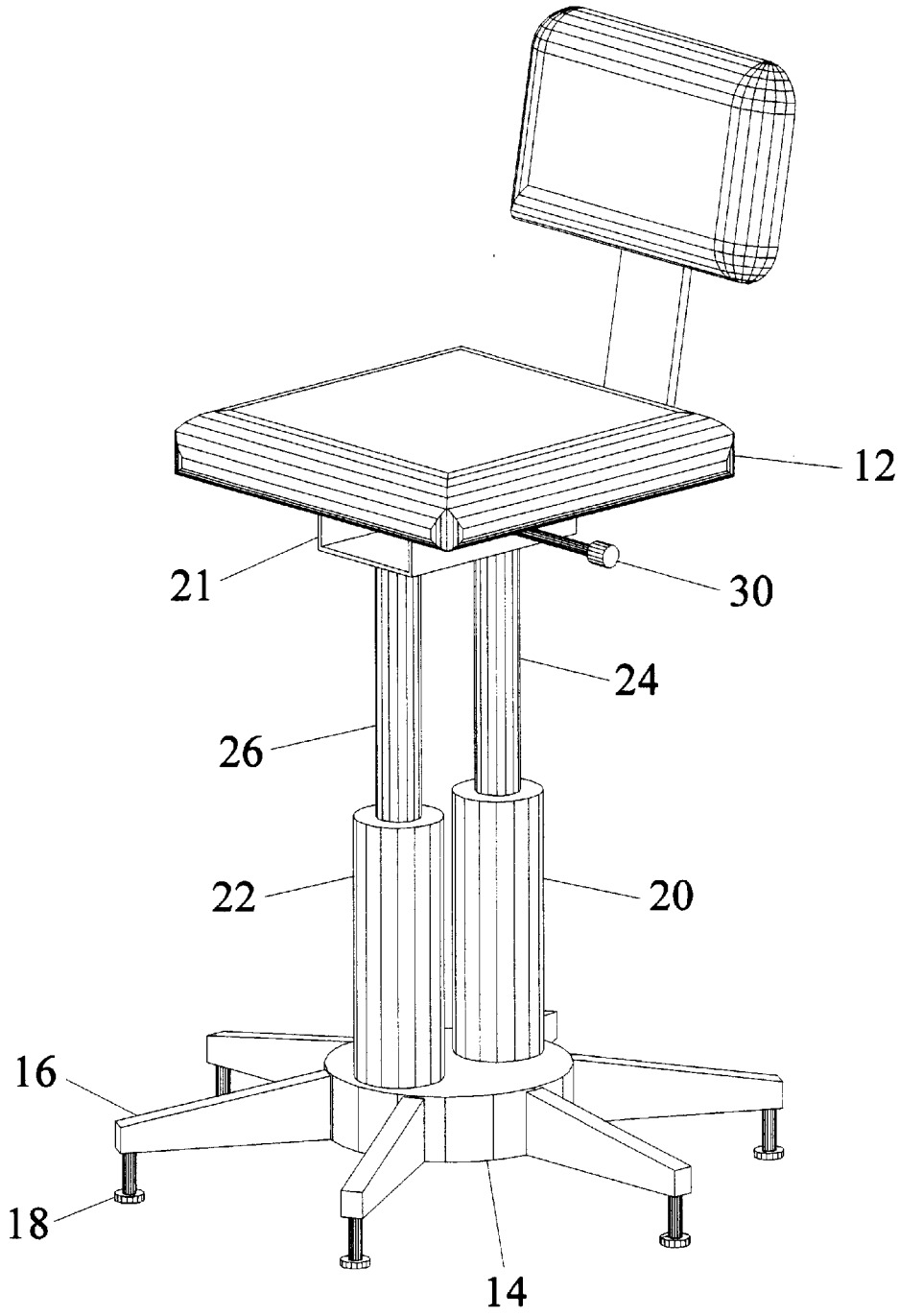
FIG. 1 shows a perspective view of a first version of the adjustable height work chair of the present invention.

In the drawings, FIG. 1 shows a perspective view of a first version of the adjustable height work chair of the present invention comprising a seat 12, a base 14, which includes spokes 16 and feet 18, and a height adjustment column secured between the seat and the base and maintaining the seat in an elevated position relative to the base. The height adjustment column includes a first gas spring 24 which is supported and extends from a first stand tube 20, and a second gas spring 26 which is supported and extends from a second stand tube 22. Stand tubes 20 and 22 are attached to the base 14. Gas springs 24 and 26 are both attached to a seat support 21 which is secured to the bottom of seat 12. Height adjustment lever 30 is also supported by the seat support and is shown extending therefrom.

Figure 2:
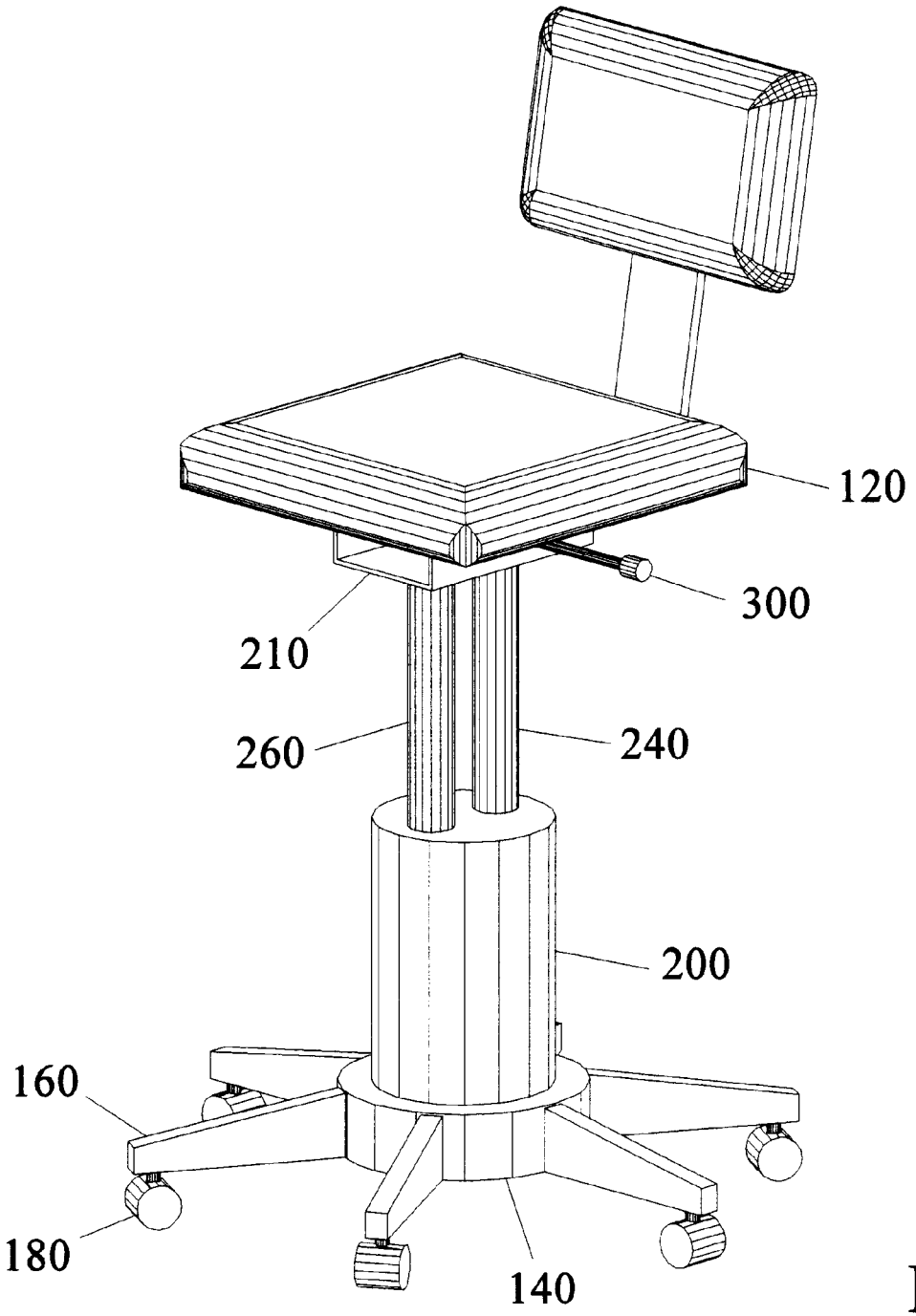
FIG. 2 is a perspective view of a second version of the adjustable height work chair of the present invention.

FIG. 2 shows a second preferred version of the height adjustable work chair of the present invention comprising a seat 120, a base 140 which includes spokes 160 and casters 180, and a height adjustable column secured between the seat and the base and maintaining the seat in an elevated position relative to the base. The height adjustable column includes a first gas spring 240 and a second gas spring 260. First and second gas springs are supported and extend from a stand tube 200. Stand tube 200 is attached to the base 140. Gas springs 240 and 260 are both attached to a seat support 210 which is secured to the bottom of seat 120. Height adjustment lever 300 is also supported by the seat support and is shown extending therefrom.

Figure 3:
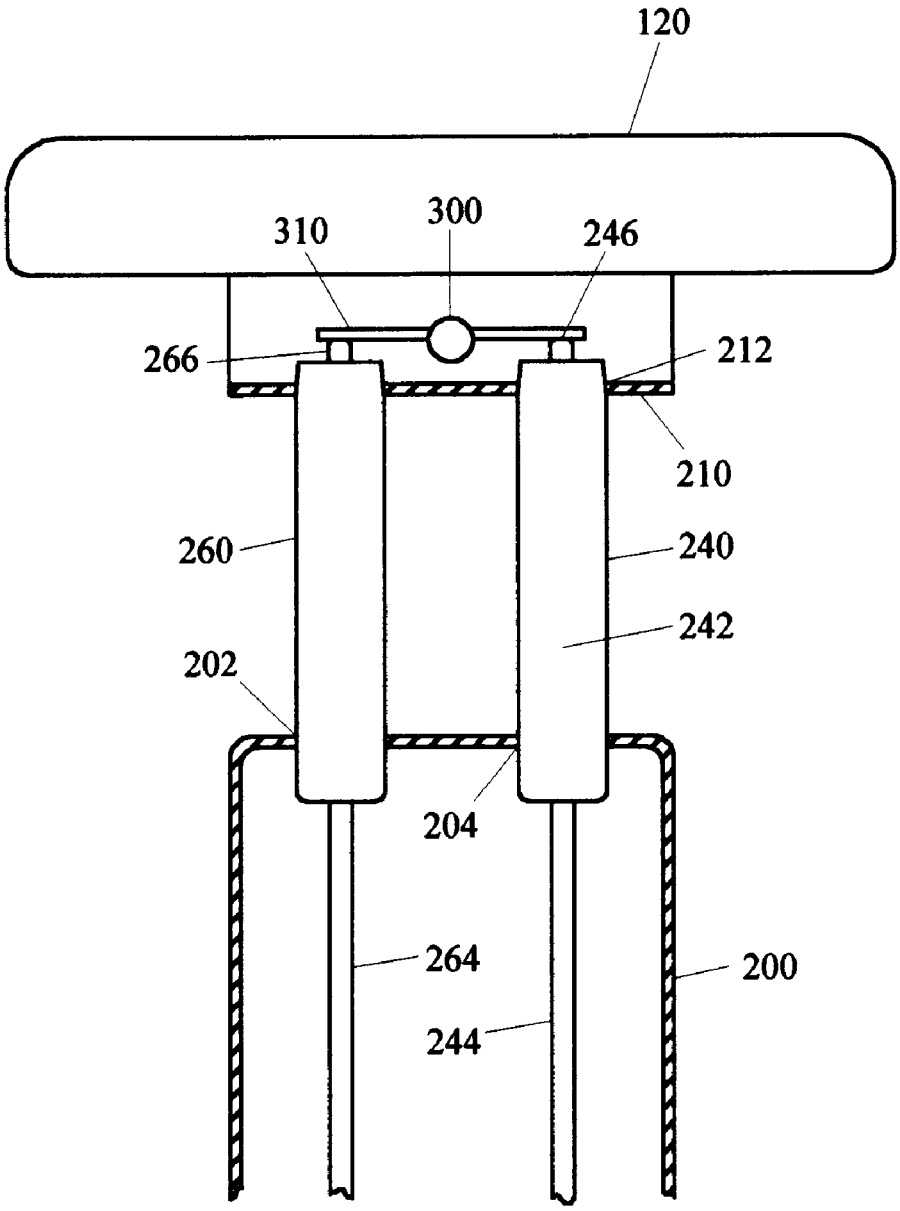
FIG. 3 is a partial side view of the height adjustment mechanism of the present invention shown in a partial cross-section.

FIG. 3 shows a version of the work chair of FIG. 2 in a partial side view with the seat support 210 and stand tube 200 shown in cross-section to reveal the details of the height adjustment column. The height adjustment column includes two lockable gas springs 240 and 260. Gas spring 240 includes a gas cylinder 240, a piston 244 extending downwardly from the cylinder and supporting the cylinder in an elevated position. Although not shown in this figure piston 244 is attached at its distal end to the chair base 140. Lockable gas spring 240 also includes a flow control valve 246 which is disposed internally of the gas cylinder and partially extends from the top of the gas cylinder 242. Similarly, lockable gas spring 260 includes a gas cylinder 260, a piston 264 and a gas flow control valve 266.

Gas cylinders 242 and 262 typically include a tapered outside diameter at the top of the cylinder which allows the gas springs to securely seat into mounting holes 212 and 214 disposed in seat support 210. The height adjustment column also includes a stand tube 200 which includes openings 202 and 204. The gas spring cylinder 242 of gas spring 240 is disposed within opening 204 and gas spring cylinder 262 of gas spring 260 is disposed within opening 202. The openings allow the gas spring cylinders to remain supported as the cylinders move vertically in relation to the piston in a telescoping manner.

FIG. 3 also shows the means to actuate the telescoping height adjustment mechanism or gas springs which comprises a lever 300 and t-bar 310. Lever 300, which toggles between a first position where the t-bar 310 does not apply pressure to valves 246 and 266 and a second position where the t-bar 310 actuates the valves 246 and 266 by applying pressure to the valves at points 246 and 266.

The pressurized gas within the cylinder is allowed to move through the valve when the valve is actuated. If a force exceeding the gas pressure is applied on the gas springs while the valve is actuated, the gas spring cylinders will move downwardly onto the piston which lowers the seat. If a force lower than the gas pressure is applied to the gas springs while the valve is actuated, the gas spring cylinders will move upwardly in relation to the piston which raises the seat.

The version of the invention as shown in FIG. 3 could be altered slightly by the use of a slightly different telescoping height adjustment mechanism. Specifically, a non-locking or open gas spring could be used in place of either of the locking gas springs 240 or 260 that are shown in the figure. A non-locking or open gas spring would typically comprising a very similar shape and construction to the locking gas springs that are shown in the figure, but would differ in that the valve does not extend beyond the top of the gas cylinder. Accordingly, the valve is actuated by the application of a force on the spring, wherein the cylinder compresses onto the piston if a force higher than the internal gas pressure is applied to the cylinder and the cylinder extends from the piston if a force less than the internal gas pressure is applied to the cylinder.

A chair in accordance with the present invention using a single locking gas spring and a single non-locking or open gas spring would use a height adjustment lever that actuates the valve on the single gas spring which includes an externally actuating valve. As such, this version would be identical to the version shown in FIG. 3 with the exception of removing the valve 246 and the t-bar section of lever 300 which actuates the valve 246.

The use of two or more gas springs prevents the gas cylinders from rotating in relation to the pistons. This structure thus prevents the seat from rotating in relation to the base. Accordingly, the chair can rotate in relation to the floor only as a complete unit. Rotating the work chair of the present invention is, or course, easiest when casters are used to support the chair base as is shown in FIG. 2.

The chair retains all the height adjustment that is required of work chairs yet is far more stable in that the chair seat does not rotate in relation to the chair base. The work chair achieves this result through the use of inexpensive gas springs that are readily available to chair manufacturers. Through the use of two or more gas springs, the work chair of the present invention achieves a higher level of durability than work chairs which utilize a single gas spring, about which the chair seat swivels. The work chair of the present invention achieves these benefits at a minimum of additional cost to chair manufacturers.

It is understood that various modifications and changes in form or detail could readily be made without departing from the spirit of the invention. It is therefore intended that the invention be not limited to the exact form and detail herein shown and described, nor to anything less than the whole of the invention herein disclosed and as hereinafter claimed.

I claim:

1. A height adjustable work chair comprising:

a seat, a base, a height adjustment column disposed intermediate the base and the seat, wherein the height adjustment column comprises at least two telescoping height adjustment mechanisms; and wherein the telescoping height adjustment mechanisms secure the seat against rotation in relation to the chair base; and wherein each telescoping height adjustment mechanism comprises a gas spring comprising:

a cylinder, a piston disposed within the cylinder and extending downwardly therefrom to a secured position on the chair base from where it supports the gas spring, a gas flow control valve disposed within the cylinder; and pressurized gas disposed within the cylinder; and means to actuate the telescoping height adjustment mechanisms;

wherein the chair seat additionally includes a seat support mechanism; underneath thereof and wherein the seat support mechanism additionally includes receiving means for receiving each telescoping height adjustment mechanism; and wherein the seat support mechanism additionally supports the means to actuate the telescoping height adjustment mechanisms.

2. The height adjustable work chair of claim 1, wherein the height adjustment column additionally comprises a stand tube having a first and a second end; wherein the first end is attached to the chair base and extends vertically therefrom, and wherein the second end includes at least two holes, and wherein one of the telescoping height adjustment mechanisms passes through each hole.

3. The height adjustable work chair of claim 1, wherein the height adjustment column additionally comprises at least two stand tubes each having a first and a second end; wherein the first end is attached to the chair base and extends vertically therefrom, and wherein the second end includes a hole, and wherein one of the telescoping height adjustment mechanisms passes through the hole.

4. The height adjustable work chair of claim 1, wherein at least one telescoping height adjustment mechanism comprises a lockable gas spring mechanism which includes a gas flow control valve extension that extends from the gas flow control valve within the gas spring cylinder; and wherein the means to actuate the height adjustment mechanisms actuates the valve of each lockable gas spring mechanisms by engaging the gas flow control valve extension of each respective lockable gas spring mechanism.

5. The height adjustable work chair of claim 4, comprising two lockable gas spring height adjustment mechanisms.

6. The height adjustable work chair of claim 4, wherein the means to actuate the height adjustment mechanisms comprises a lever that toggles between a first position wherein the gas flow control valve of each lockable telescoping height adjustment mechanism is not actuated and a second position wherein the gas flow control valve of each lockable telescoping height adjustment mechanism is actuated; and wherein the lever in the second position actuates the gas flow control valve to allow gas to move through the gas flow control valve which selectively lowers the cylinder if a force exceeding the gas pressure is applied on the gas spring or raises the cylinder if a force less than the gas pressure is applied on the gas spring.

* * * * *